US009743209B2

(12) United States Patent
Honda et al.

(10) Patent No.: US 9,743,209 B2
(45) **Date of Patent: *Aug. 22, 2017**

(54) LOUDSPEAKER AND MOBILE DEVICE EQUIPPED WITH THE SAME

(71) Applicant: Panasonic Intellectual Property Management Co., Ltd., Osaka (JP)

(72) Inventors: Kazuki Honda, Osaka (JP); Mitsukazu Kuze, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/023,683

(22) PCT Filed: Jul. 3, 2015

(86) PCT No.: PCT/JP2015/003357

§ 371 (c)(1),
(2) Date: Mar. 22, 2016

(87) PCT Pub. No.: WO2016/002231

PCT Pub. Date: Jan. 7, 2016

(65) Prior Publication Data

US 2016/0234618 A1 Aug. 11, 2016

(30) Foreign Application Priority Data

Jul. 4, 2014 (JP) ..... 2014-138803
Aug. 4, 2014 (JP) ..... 2014-158314

(51) Int. Cl.

| | |
|---|---|
| ***H04R 1/02*** | (2006.01) |
| ***H04R 31/00*** | (2006.01) |
| ***H04R 7/02*** | (2006.01) |
| ***H04R 7/18*** | (2006.01) |

(Continued)

(52) U.S. Cl.
CPC ..... *H04R 31/006* (2013.01); *H04R 1/02* (2013.01); *H04R 1/025* (2013.01); *H04R 7/02* (2013.01);

(Continued)

(58) Field of Classification Search
CPC ..... H04R 31/006; H04R 1/02; H04R 1/025; H04R 7/02; H04R 7/18; H04R 9/025;

(Continued)

(56) References Cited

U.S. PATENT DOCUMENTS 4,122,314 A 10/1978 Matsuda et al.
5,418,337 A * 5/1995 Schreiber ..... H04R 7/12 181/171

(Continued)

FOREIGN PATENT DOCUMENTS

| | | |
|---|---|---|
| JP | 56-056095 | 5/1981 |
| JP | 57-122997 U | 7/1982 |
| WO | 2013/144597 | 10/2013 |

OTHER PUBLICATIONS

International Search Report of PCT application No. PCT/JP2015/003357 dated Sep. 29, 2015.

(Continued)

*Primary Examiner* — Tuan D Nguyen
(74) *Attorney, Agent, or Firm* — McDermott Will & Emery LLP

(57) ABSTRACT

A loudspeaker includes a frame, a diaphragm, a voice coil body, a terminal, and a relay wire. The diaphragm includes a thin part and a thick part formed around the thin part. The voice coil body includes a bobbin and a voice coil, and is placed in the center of the diaphragm. The terminal is fixed to the frame. The relay wire is connected to the terminal and the voice coil. At least part of the relay wire is located in the thick part.

18 Claims, 15 Drawing Sheets

(51) Int. Cl.

| | |
|---|---|
| ***H04R 9/02*** | (2006.01) |
| ***H04R 9/06*** | (2006.01) |
| *H04R 7/10* | (2006.01) |
| *H04R 7/20* | (2006.01) |
| *H04R 9/04* | (2006.01) |

(52) U.S. Cl.
CPC ..... *H04R 7/18* (2013.01); *H04R 9/025* (2013.01); *H04R 9/06* (2013.01); *H04R 7/10* (2013.01); *H04R 7/20* (2013.01); *H04R 9/04* (2013.01); *H04R 2499/13* (2013.01)

(58) Field of Classification Search
CPC ... H04R 9/06; H04R 7/10; H04R 7/20; H04R 9/04; H04R 2499/13
See application file for complete search history.

(56) References Cited

U.S. PATENT DOCUMENTS

| | | | | |
|---|---|---|---|---|
| 6,449,376 | B1 | 9/2002 | Beltran et al. | |
| 6,757,404 | B2 | 6/2004 | Takewa et al. | |
| 2002/0121403 | A1 | 9/2002 | Sahyoun | |
| 2002/0146145 | A1* | 10/2002 | James | H04R 9/046 381/426 |
| 2005/0031153 | A1 | 2/2005 | Nguyen et al. | |
| 2006/0088184 | A1* | 4/2006 | Ohashi | H04R 7/16 381/430 |
| 2007/0154056 | A1* | 7/2007 | Proni | H04R 9/022 381/396 |
| 2007/0165886 | A1 | 7/2007 | Topliss et al. | |
| 2011/0211725 | A1 | 9/2011 | Takewa et al. | |
| 2011/0299716 | A1 | 12/2011 | Reckert | |
| 2013/0064413 | A1 | 3/2013 | Cazes Bouchet | |
| 2016/0118032 | A1 | 4/2016 | Kawka et al. | |
| 2016/0249137 | A1 | 8/2016 | Honda et al. | |
| 2016/0277839 | A1* | 9/2016 | Shikimachi | H04R 1/2834 |

OTHER PUBLICATIONS

Notice of Allowance issued in U.S. Appl. No. 15/023,388 dated Apr. 28, 2017.

* cited by examiner

LOUDSPEAKER AND MOBILE DEVICE EQUIPPED WITH THE SAME

This application is a U.S. national stage application of the PCT international application No. PCT/JP2015/003357.

TECHNICAL FIELD

The present disclosure relates to an electrodynamic loudspeaker used in audio systems and to a mobile device equipped with the loudspeaker.

BACKGROUND ART

A conventional loudspeaker includes a frame, a diaphragm, a magnetic circuit, a voice coil body, a terminal, and a relay wire. The diaphragm is connected at its outer periphery to the frame. The magnetic circuit has a magnetic gap and is formed in the frame. The terminal is fixed to the frame. The voice coil receives audio signals from another device through the terminal.

The voice coil body includes a bobbin and a voice coil wound around the bobbin. The bobbin is connected at one end to the diaphragm, and the voice coil is located in the magnetic gap.

The relay wire connects the terminal and the voice coil. The terminal is typically connected to the relay wire, such as a tinsel wire or a lead wire in a space on the rear side of the diaphragm. The relay wire is fixed to the rear side of the diaphragm with, for example, an adhesive tape.

An example of a conventional technique related to the invention of the present application is shown in Patent Literature 1.

CITATION LIST

Patent Literature

PTL 1: Japanese unexamined utility model application No. 57-122997

SUMMARY OF THE INVENTION

The loudspeaker of the present disclosure includes a frame, a diaphragm, an edge, a magnetic circuit, a voice coil body, a terminal, and a relay wire.

The frame has a hollow.

The diaphragm is located in the hollow of the frame and has a first side and a second side opposite to each other. The first side of the diaphragm is the surface of a recess defined by a thin part and a thick part formed around the thin part.

The edge connects the outer peripheral end of the diaphragm and the frame.

The magnetic circuit is placed facing the recess and has a magnetic gap.

The voice coil body includes a cylindrical bobbin and a voice coil wound around at least part of the bobbin. The voice coil body is placed in the center of the diaphragm so that the voice coil is located in the magnetic gap.

The terminal is fixed to the frame.

The relay wire is connected at the first end to the terminal and connected at the second end to the voice coil. At least part of the relay wire is located in the thick part.

The mobile device of the present disclosure includes a body, a drive part mounted in the body, an amplifier mounted in the body, and the loudspeaker of the present disclosure, which receives the output of the amplifier.

DESCRIPTION OF EMBODIMENT

The conventional loudspeaker requires a space for placing the relay wires on the rear side of the diaphragm. This space causes the loudspeaker to have a thick profile.

Loudspeakers come in various shapes depending on the application. For example, in-car loudspeakers need to have a thin profile because they are placed in small spaces such as a dashboard, a door, or a roof.

Figure 1:
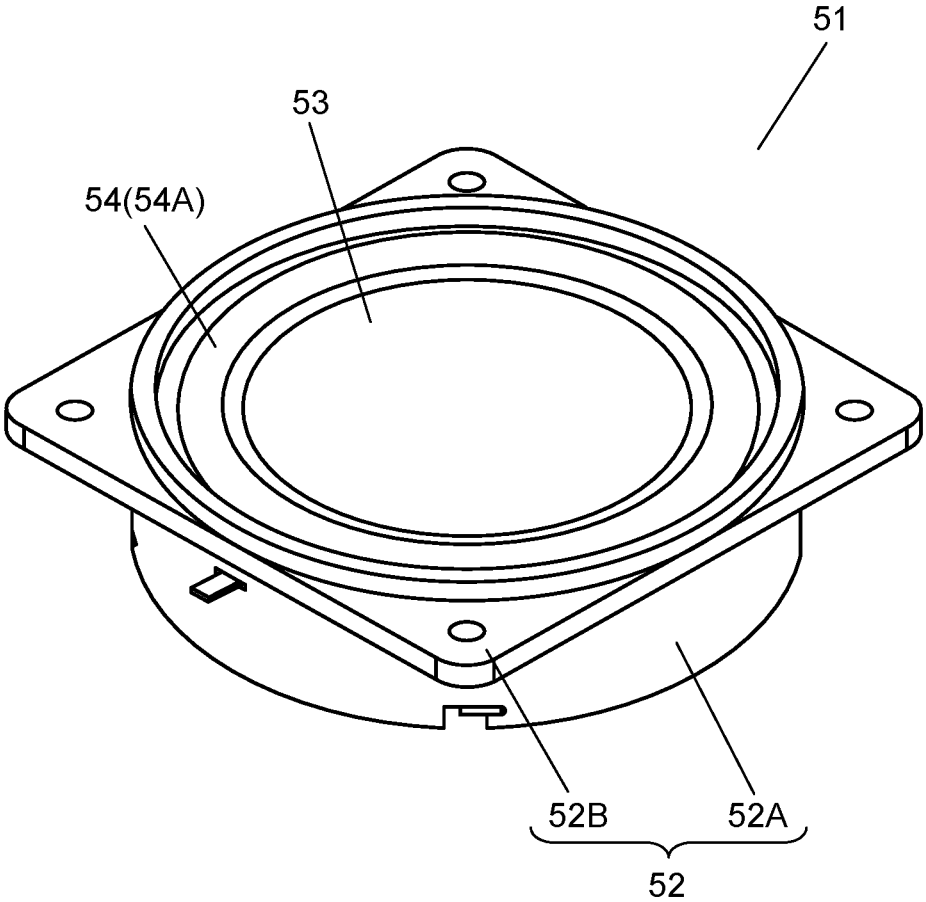
FIG. 1 is a perspective view of a loudspeaker according to a present exemplary embodiment.
Figure 2:
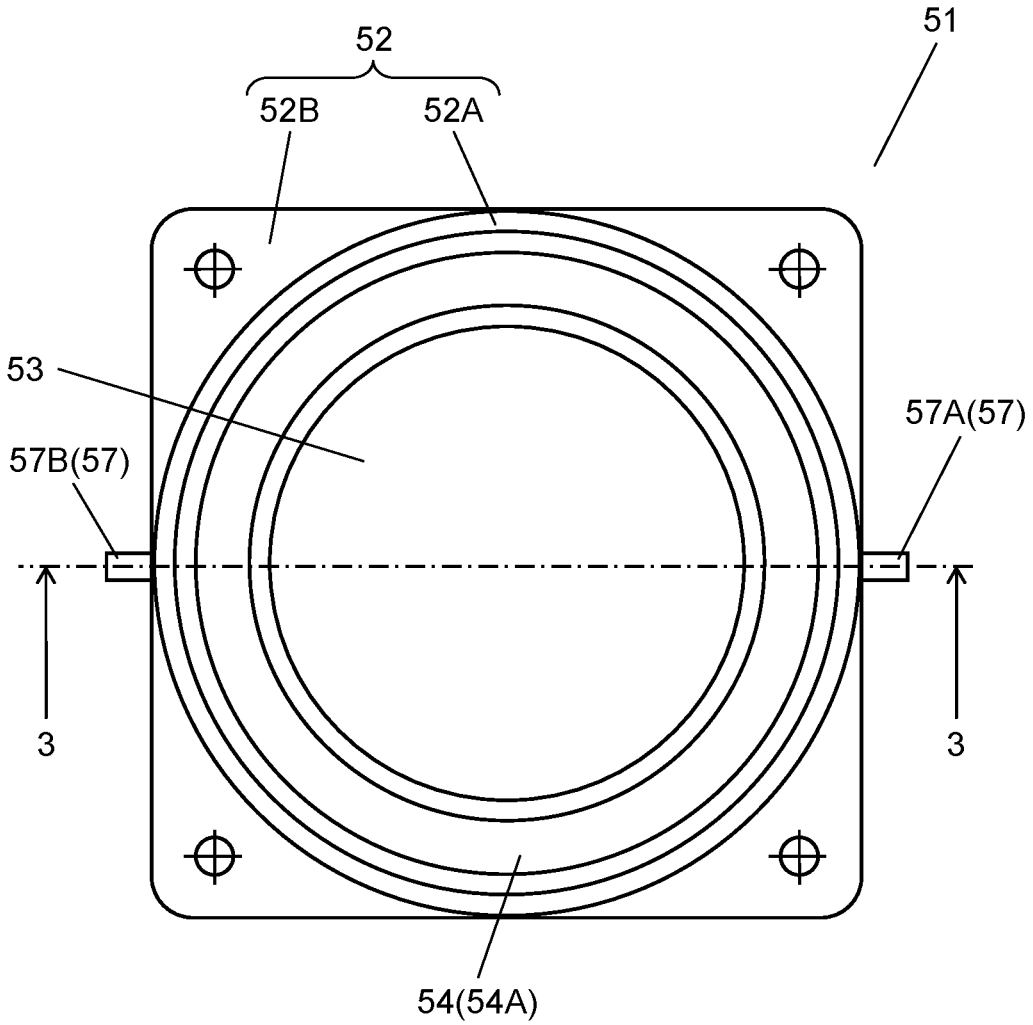
FIG. 2 is a front view of the loudspeaker according to the present exemplary embodiment.
Figure 3:
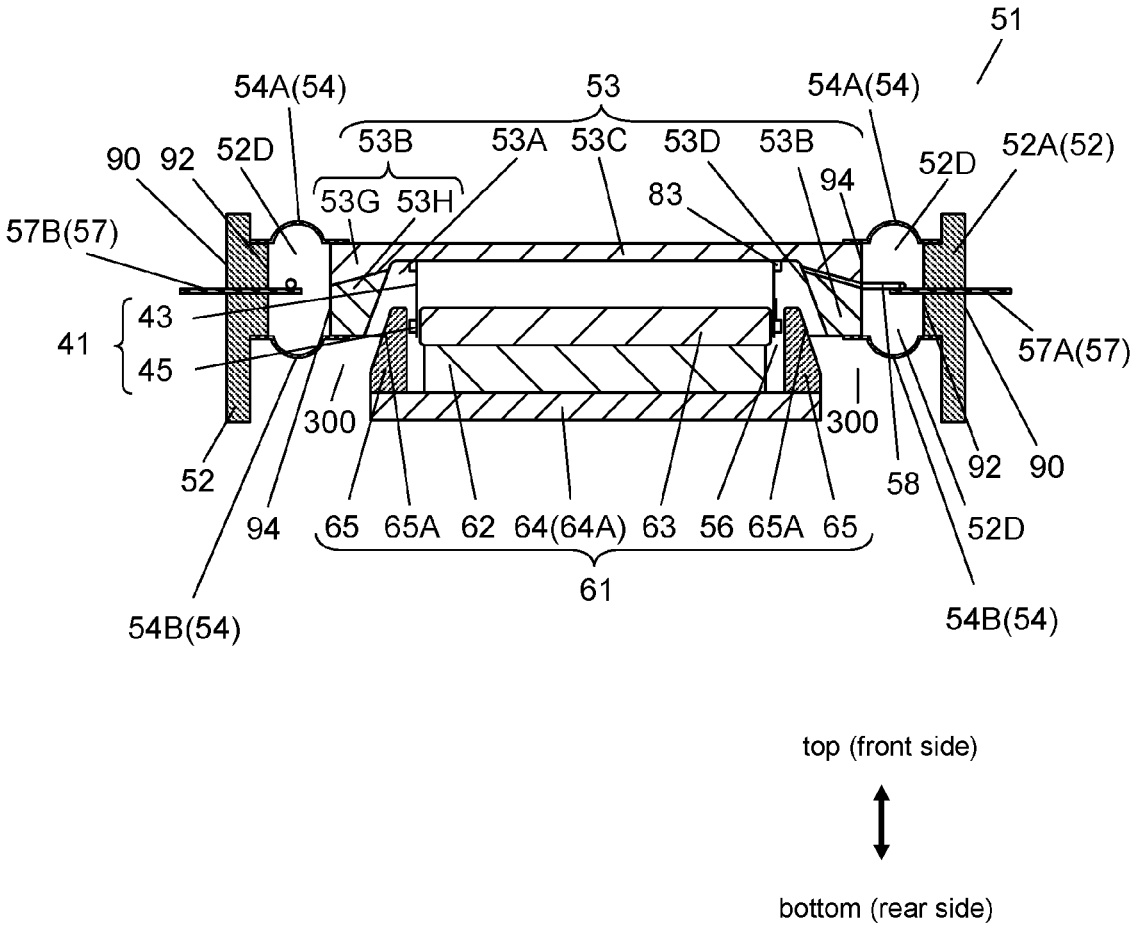
FIG. 3 is a sectional view taken along line 3-3 of FIG. 2.

Thin loudspeaker 51 according to the present exemplary embodiment will now be described with reference to drawings. FIG. 1 is a perspective view of loudspeaker 51. FIG. 2 is a front view of loudspeaker 51. FIG. 3 is a sectional view taken along line 3-3 of FIG. 2.

Loudspeaker 51 includes frame 52, diaphragm 53, edge 54, magnetic circuit 61, voice coil body 41, terminal 57, and relay wire 58.

Frame 52 has hollow 300.

Diaphragm 53 has a first side and a second side opposite to each other and is placed in hollow 300 of frame 52. The first side of diaphragm 53 is the surface of recess 53A defined by thin part 53C and thick part 53B formed around thin part 53C.

Edge 54 connects the outer peripheral end of diaphragm 53 and frame 52.

Magnetic circuit 61 is placed facing recess 53A and has magnetic gap 56.

Voice coil body 41 includes cylindrical bobbin 43 and voice coil 45 wound around at least part of bobbin 43. Voice coil body 41 is placed in the center of diaphragm 53 so that voice coil 45 can be located in magnetic gap 56.

Terminal 57 is fixed to frame 52.

Relay wire 58 is connected at its first end to terminal 57 and at its second end to voice coil 45. At least part of relay wire 58 is located in thick part 53B.

Terminal 57 includes positive terminal 57A and negative terminal 57B.

Bobbin 43 is connected to the center of diaphragm 53.

With this configuration, loudspeaker 51 needs only a small space for placing relay wire 58 on the rear side of diaphragm 53, thereby having a thin profile. The term "rear side" used here means the side of diaphragm 53 which faces magnetic circuit 61 in FIG. 3. The "front side" is opposite to the "rear side".

Relay wire 58 penetrates thick part 53B of diaphragm 53 and is placed within thick part 53B. As a result, relay wire 58 does not come into contact with magnetic circuit 61 or frame 52 while diaphragm 53 is in motion, thereby reducing the occurrence of abnormal noise caused by their contact.

Loudspeaker 51 will now be described in more detail. As shown in FIG. 1, frame 52 includes base 52A, which is hollow cylinder, and attachment part 52B. Base 52A is preferably cylindrical in the case that diaphragm 53 is circular when seen from front. Frame 52 does not have to include attachment part 52B, but preferably includes it for the following reason. Attachment part 52B allows loudspeaker 51 to be attached to a baffle board (not shown) or other device. If attachment part 52B has screw holes, loudspeaker 51 can be screwed to the baffle board.

As shown in FIG. 3, frame 52 has outer surface 90 and inner surface 92. Loudspeaker 51 has gap 52D between outer peripheral surface 94 of diaphragm 53 and inner surface 92 of frame 52. Terminal 57 passes through inner surface 92 and outer surface 90 of frame 52. One end of terminal 57 is located in gap 52D. Relay wire 58 lead out of thick part 53B is routed in gap 52D toward terminal 57. Relay wire 58 is preferably led out from the lateral side of the outer periphery of diaphragm 53 so as to reduce the space for placing relay wire 58 on the rear side of diaphragm 53, thereby allowing loudspeaker 51 to have a thin profile.

In the present exemplary embodiment, the term "edge 54" is used to collectively refer to first edge 54A and second edge 54B. First and second edges 54A and 54B connect the outer peripheral end of diaphragm 53 and frame 52. Loudspeaker 51 can have a thin profile by the following configurations: second edge 54B is preferably located on the opposite side of first edge 54A in the thickness direction of thick part 53B; terminal 57 is preferably located between first edge 54A and second edge 54B in the thickness direction of diaphragm 53; and relay wire 58 is preferably led out from the lateral side of the outer periphery of diaphragm 53.

First edge 54A is preferably connected to the front side of diaphragm 53, and second edge 54B is preferably connected to the rear side of thick part 53B. This configuration provides a large distance between first and second edges 54A and 54B, thereby preventing edge 54 from coming into contact with terminal 57 and also preventing the occurrence of rolling action of diaphragm 53.

First edge 54A and second edge 54B are preferably symmetrical with respect to the surface normal to the direction of the winding axis of voice coil 45 (vertical direction in FIG. 3) or, in other words, normal to the direction of the vibration (amplitude) of diaphragm 53. This configuration allows diaphragm 53 to have excellent strain characteristics. Instead of providing both first and second edges 54A and 54B, either one may be provided.

Figure 4:
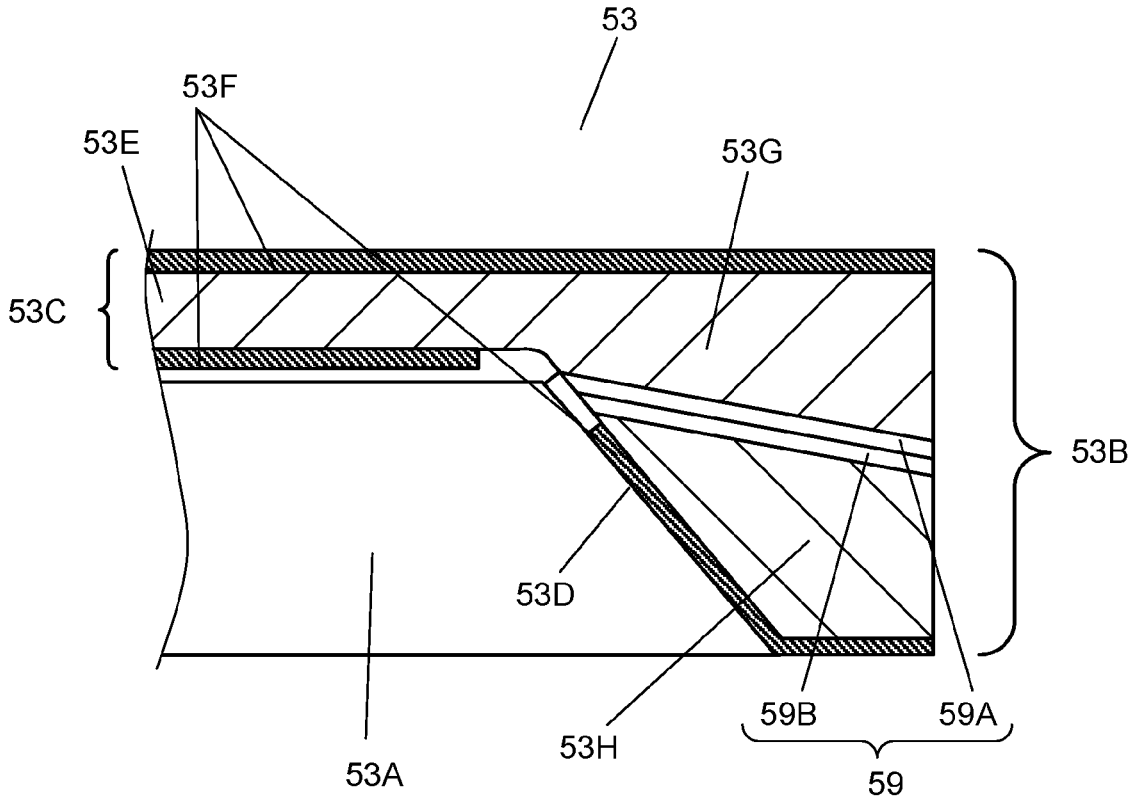
FIG. 4 is an enlarged sectional view of an essential part of a diaphragm of the loudspeaker according to the present exemplary embodiment.

FIG. 4 is an enlarged sectional view of an essential part of diaphragm 53 of loudspeaker 51 (excluding relay wire 58). Diaphragm 53 has thin part 53C and thick part 53B formed around thin part 53C. Thin part 53C and thick part 53B define recess 53A. More specifically, thick part 53B is formed around the outer periphery of diaphragm 53, and recess 53A is formed in the center of the rear side of diaphragm 53. The front side of diaphragm 53 is preferably flat.

Thin part 53C is thinner than thick part 53B, and has a flat rear side. In thin part 53C, diaphragm 53 has a uniform thickness to prevent undesired resonances.

Thick part 53B of diaphragm 53 has through-holes 59, and is preferably composed of diaphragm front part 53G and diaphragm back part 53H. For example, through-holes 59 can be formed as follows: grooves 59A are formed on the rear side of diaphragm front part 53G and grooves 59B are formed on the front side of diaphragm back part 53H. Grooves 59A and grooves 59B are located facing each other when diaphragm front part 53G and diaphragm back part 53H are bonded to each other. When these parts 53G and 53H are bonded to each other, grooves 59A and grooves 59B form through-holes 59. At least part of relay wire 58 is inserted into through-holes 59.

As an alternative process, it is possible to sandwich at least part of relay wire 58 between grooves 59A of diaphragm front part 53G and grooves 59B of diaphragm back part 53H, and then to bond diaphragm front part 53G and diaphragm back part 53H together with an adhesive or the like. This configuration eliminates the process of inserting relay wire 58 into through-holes 59, thereby reducing the assembly man-hours of loudspeaker 51. Thus, loudspeaker 51 can be manufactured more easily than in the case of forming through-holes 59 in thick part 53B first and then inserting relay wire 58 into through-holes 59.

Through-holes 59 are formed by combining grooves 59A and grooves 59B, but may alternatively be formed by either grooves 59A or grooves 59B. More specifically, through-holes 59 may be formed by grooves 59A and the front side of diaphragm back part 53H, or by grooves 59B and the rear side of diaphragm front part 53G.

Diaphragm 53 preferably has core material 53E made of foamed resin and reinforcement layer 53F. This configuration allows diaphragm 53 to be lightweight, to have highly responsive properties, and hence, to provide quick sound rise. The configuration also improves the output sound pressure level of diaphragm 53 and extends the reproduction frequency range at high frequencies. The foamed resin used as core material 53E is preferably of rigid type so that diaphragm 53 can have a high speed of sound and a high sound pressure level.

As another alternative process, it is possible to sandwich relay wire 58 between diaphragm front part 53G and diaphragm back part 53H, and then to compress and bond these parts 53G and 53H together. In this case, the foamed resin used as core material 53E is preferably to be of soft type. The compression allows the formation of grooves along relay wire 58 on the rear side of diaphragm front part 53G and on the front side of diaphragm back part 53H. As a result, relay wire 58 is fixed to diaphragm 53 while being sandwiched between these parts 53G and 53H. This configuration facilitates and improves the manufacture of diaphragm 53. The configuration can also reduce the occurrence of a gap between relay wire 58 and diaphragm 53, thereby reducing the occurrence of abnormal noise caused by their contact. It is possible to use an adhesive to bond relay wire 58 and diaphragm 53 together, thereby further reducing the occurrence of abnormal noise caused by their contact.

Reinforcement layer 53F is preferably formed on at least one of the front and rear sides of core material 53E so as to improve the strength of diaphragm 53. Reinforcement layer 53F is preferably made of rigid, lightweight material so as to allow diaphragm 53 to have a high speed of sound and a high sound pressure level. The material of reinforcement layer 53F can be, for example, carbon or metal, such as aluminum or titanium.

Figure 5:
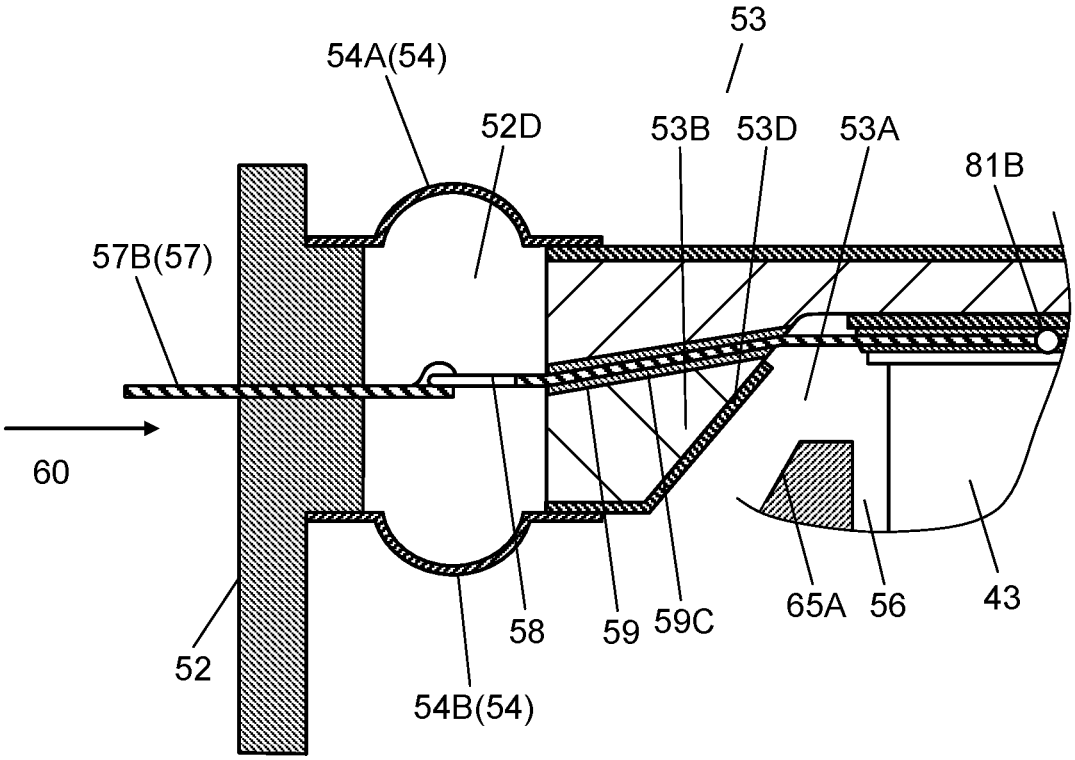
FIG. 5 is an enlarged sectional view of an essential part of the loudspeaker according to the present exemplary embodiment.
Figure 6:
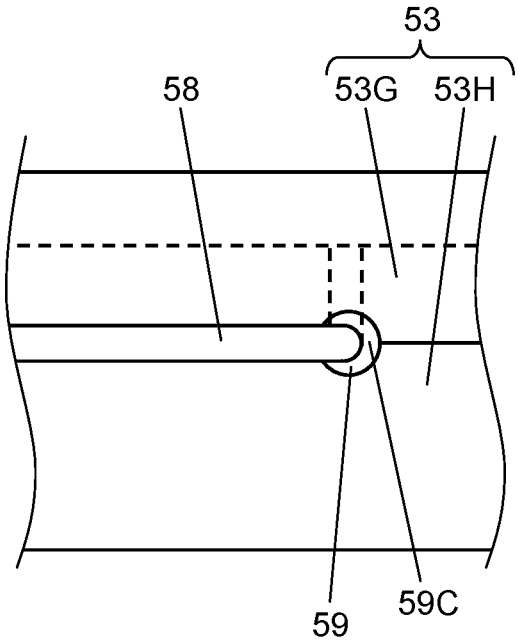
FIG. 6 is an enlarged side view of the essential part of the loudspeaker according to the present exemplary embodiment.

FIG. 5 is an enlarged sectional view of an essential part of loudspeaker 51. FIG. 6 is an enlarged side view of the essential part of loudspeaker 51. In FIG. 6, frame 52 and magnetic circuit 61 are removed, and diaphragm 53 is seen from side (from the direction of arrow 60 in FIG. 5). Relay wire 58 is inserted into through-holes 59 and penetrates thick part 53B. In this case, one end of relay wire 58 is led out from each through-hole 59 to gap 52D. Thus, one end of each through-hole 59 is formed at outer peripheral surface 94 of diaphragm 53. The other end of each through-hole 59 is preferably formed at inclined surface 53D of recess 53A. In other words, it is preferable that through-holes 59 penetrate between the inner peripheral surface and outer peripheral surface 94 of diaphragm 53. Through-holes 59 shown in FIG. 4 preferably have a sufficiently large diameter, which is at least larger than that of relay wire 58.

Through-holes 59 are preferably filled with filler 59C so as to reduce the chance of relay wire 58 coming into contact with the inner wall of through-holes 59, thereby reducing the occurrence of abnormal noise. Filler 59C can be a lubricant agent such as grease so that relay wire 58 can move freely in the direction perpendicular to its axis inside through-holes 59. This reduces the stress of relay wire 58 while diaphragm 53 is vibrating.

The lubricant agent used as filler 59C can be replaced by an adhesive, and relay wire 58 and the inner wall of through-holes 59 may be embedded in the adhesive. This configuration further reduces the chance of relay wire 58 coming into contact with the inner wall of through-holes 59. Furthermore, the adhesive can be applied to the mating surfaces of diaphragm front part 53G and diaphragm back part 53H shown in FIG. 4 so as to be injected into through-holes 59. This eliminates the process of forming through-holes 59 and the process of filling through-holes 59 with the adhesive.

Alternatively, relay wire 58 may be located in thick part 53B without forming through-holes 59 in thick part 53B. For example, relay wire 58 may be integrally formed with diaphragm 53 by being insert-molded during the process of molding diaphragm 53. This eliminates the process of forming through-holes 59 in diaphragm 53 and the process of inserting relay wire 58 into through-holes 59, thereby increasing the production of diaphragm 53.

As shown in FIG. 3, voice coil body 41 includes cylindrical bobbin 43 and voice coil 45. The term "cylindrical" here includes rectangular-column shaped. Voice coil 45 is wound around at least part of bobbin 43. One end of bobbin 43, or in other words, the first end (front side part) of bobbin 43, is connected to thin part 53C of recess 53A. Voice coil 45 is wound near the second end (rear side part) of bobbin 43 and is located in magnetic gap 56. When a drive signal is supplied to voice coil 45, diaphragm 53 vibrates according to the direction and magnitude of the drive signal. Diaphragm 53 is driven in the direction of the winding axis of voice coil 45 (vertical direction in FIG. 3) via bobbin 43.

Figure 7:
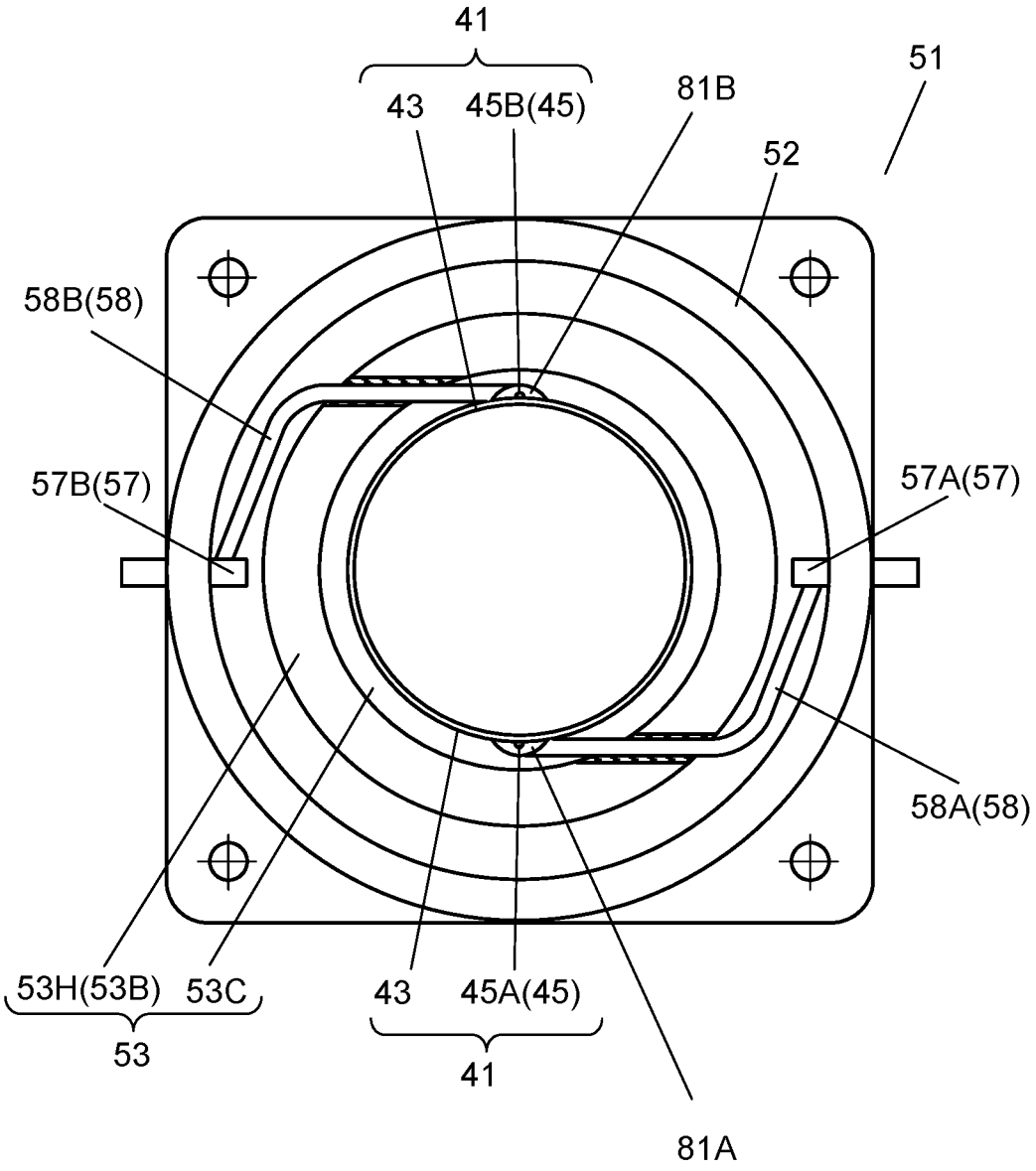
FIG. 7 is a rear view of the loudspeaker (excluding a magnetic circuit) according to the present exemplary embodiment.

Both terminals (first terminal 45A and second terminal 45B shown in FIG. 7) of voice coil 45 are led toward diaphragm 53 along bobbin 43. These terminals 45A and 45B are connected to relay wire 58 in connection parts (connection part 81A and connection part 81B), respectively as shown in FIG. 7. Connection parts 81A and 81B are preferably formed on bobbin 43.

It is more preferable to form connection parts 81A and 81B in recess 53A (thin part 53C) than on the rear side of thick part 53B, or in other words, to form near the front side of diaphragm 53. This allows the upper surface of magnetic circuit 61 and the front side of diaphragm 53 to be located close to each other, and hence, loudspeaker 51 to have a thin profile.

Connection parts 81A and 81B may alternatively be formed on bobbin 43 instead of on diaphragm 53, or be formed at the joint between bobbin 43 and diaphragm 53.

It is preferable to use an adhesive to bond bobbin 43 and diaphragm 53 together. It is also preferable to use an adhesive to bond connection parts 81A, 81B, part of voice coil 45, part of relay wire 58, and either bobbin 43 or diaphragm 53, so that connection parts 81A and 81B can be prevented from being detached from bobbin 43 or diaphragm 53. The adhesive also functions as a reinforcing material between voice coil 45 and relay wire 58, thereby enhancing the connection reliability between them in connection parts 81A and 81B.

Bobbin 43 may be integrally formed with diaphragm 53 by being insert-molded during the process of producing diaphragm 53. In this case, voice coil 45 can be preferably bonded to the terminal of relay wire 58 inside diaphragm 53 during the insert molding.

Figure 8:
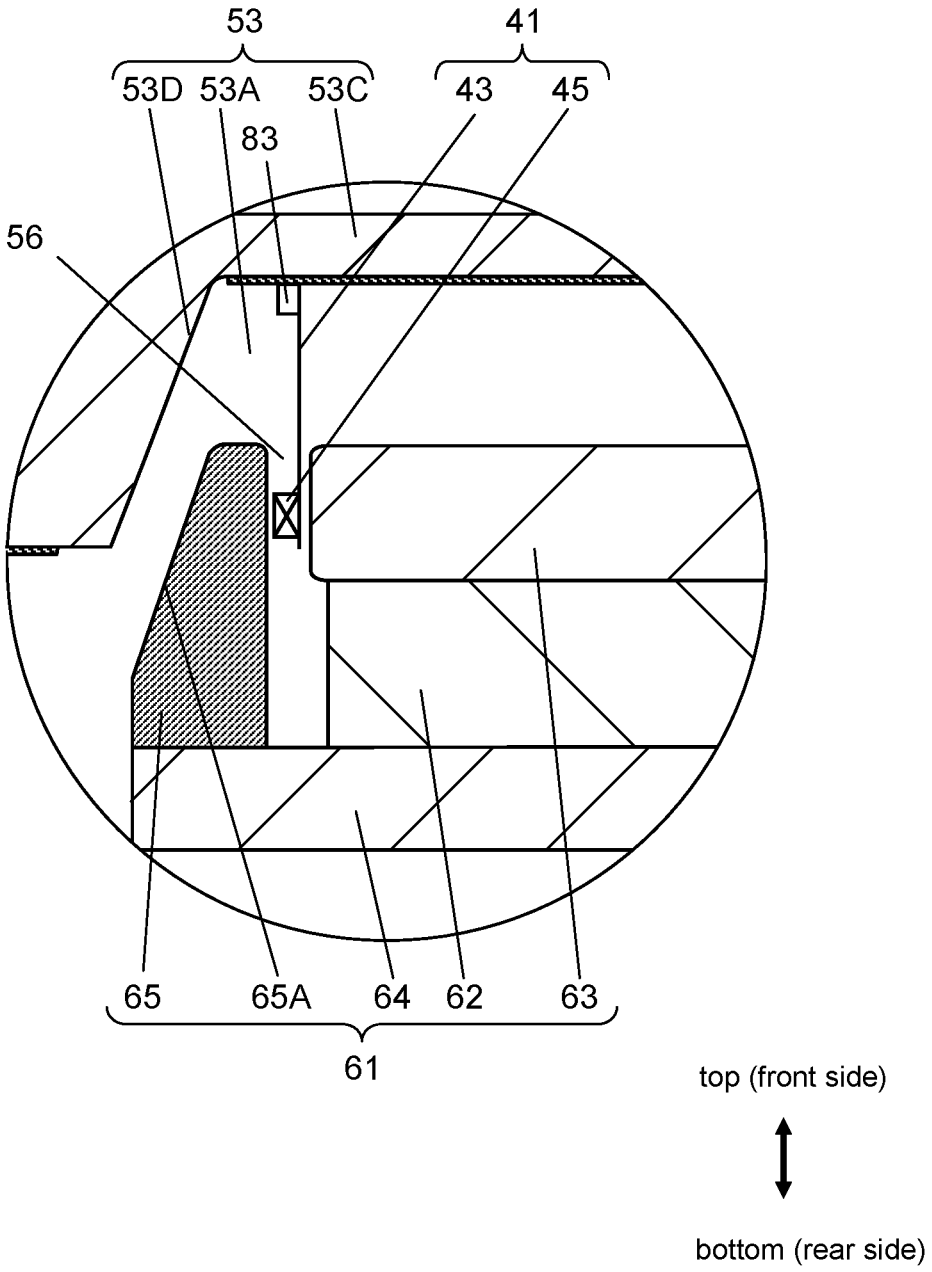
FIG. 8 is an enlarged sectional view of an essential part of a magnetic gap of the loudspeaker according to the present exemplary embodiment.

It is preferable to provide reinforcement part 83 shown in FIGS. 3 and 8 at the joint between bobbin 43 and diaphragm 53. Reinforcement part 83 can be a ring-shaped projection made of kraft paper, resin, or a thin sheet of light metal such as aluminum. Considering the weight of diaphragm 53, reinforcement part 83 is preferably made of foamed resin. In addition, reinforcement part 83 is preferably formed in contact with the lateral side of the inner peripheral surface or outer peripheral surface of the bobbin. Reinforcement part 83 improves the bond strength between bobbin 43 and diaphragm 53, thereby reducing the loss of the driving force while being transmitted from bobbin 43 to diaphragm 53.

FIG. 7 is a rear view of loudspeaker 51 (excluding magnetic circuit 61). In connection part 81A, first terminal 45A of voice coil 45 is connected to positive relay wire 58A. In connection part 81B, second terminal 45B of voice coil 45 is connected to negative relay wire 58B. Positive relay wire 58A and negative relay wire 58B are collectively referred to as relay wire 58.

Connection parts 81A and 81B are preferably located 180° rotationally symmetric with respect to the rotation axis of voice coil 45. This configuration allows the center of gravity of the assembly including voice coil body 41, diaphragm 53, and relay wire 58 to be easily located on the central axis of the voice coil. As a result, diaphragm 53 is balanced with the central axis of voice coil 45, and hence, generates less rolling action. The configuration also reduces the size of magnetic gap 56, thereby increasing the magnetic flux density in magnetic gap 56, or in other words, reducing the thickness of magnet 62 shown in FIG. 3.

Positive terminal 57A and negative terminal 57B are also preferably located 180° rotationally symmetric with respect to the central axis of voice coil 45 so that these terminals 57A and 57B can be equal in length and weight. Positive relay wire 58A and negative relay wire 58B are also preferably located 180° rotationally symmetric with respect to the central axis of voice coil 45. This configuration reduces the occurrence of rolling action of diaphragm 53 and increases the magnetic flux density of magnetic gap 56, allowing magnetic circuit 61 to have a thin profile.

Relay wire 58 is preferably led out tangentially from bobbin 43. In this case, the end of relay wire 58 on the voice coil 45 side can be shaped to fit the outer peripheral surface of bobbin 43 so as to be easily bonded to bobbin 43. This improves the connection reliability between relay wire 58 and voice coil 45.

Relay wire 58 is preferably a tinsel wire, or may alternatively be formed by extending the wire of voice coil 45. In the case that reinforcement layer 53F shown in FIG. 4 is made of a conductive material, relay wire 58 is preferably covered with an insulating material or an insulating tube. The covering material is preferably a heat resistant or insulating material. In the case that connection parts 81A and 81B are formed on the surface of diaphragm 53, it is preferable to form an insulating part on the surface of diaphragm 53 so as to prevent a short circuit between relay wire 58 and reinforcement layer 53F. Relay wire 58 may be a vinyl wire instead of the tinsel wire.

As shown in FIG. 3, recess 53A is preferably located facing the upper surface of magnetic circuit 61. More specifically, diaphragm 53 includes a first side and a second side opposite to each other, and the first side is the surface of recess 53A defined by thick part 53B and thin part 53C formed inside thick part 53B. Magnetic circuit 61 faces the first side. With this configuration, the distance can be small between the upper surface of magnetic circuit 61 and the front side of diaphragm 53, allowing the loudspeaker to have a thin profile. In addition, thick part 53B formed in the outer periphery of diaphragm 53 increases the strength of diaphragm 53. The upper surface of magnetic circuit 61 is preferably located closer to the front side of diaphragm 53 than to the rear side of thick part 53B, allowing loudspeaker 51 to have a thinner profile. In short, it is preferable that part of the magnetic circuit be located in recess 53A.

It is preferable that the boundary portion between thin part 53C and thick part 53B gradually increase toward the outer periphery of diaphragm 53. More specifically, it is preferable that inclined surface 53D of recess 53A gradually increase in thickness from thin part 53C toward thick part 53B so as to enhance the strength of diaphragm 53. Furthermore, the surface between thin part 53C and inclined surface 53D is preferably chamfered or curved. This can reduce the stress concentration at the intersection of thin part 53C and inclined surface 53D, allowing diaphragm 53 to be stronger.

Magnetic circuit 61 preferably has tapered part 65A on its lateral side, and inclined surface 53D of diaphragm 53 preferably faces tapered part 65A. With this configuration, the distance can be small between tapered part 65A and inclined surface 53D, allowing the upper surface of magnetic circuit 61 and the front side of diaphragm 53 to be located close to each other. The distance between tapered part 65A and inclined surface 53D is further reduced by making relay wire 58 penetrate thick part 53B so as to reduce the space for placing relay wire 58 between tapered part 65A and inclined surface 53D.

FIG. 8 is an enlarged sectional view of an essential part of magnetic gap 56 of loudspeaker 51. Magnetic circuit 61 is of internal magnet type, and preferably includes bottom plate 64, yoke 65, magnet 62, and top plate 63. Magnet 62 is mounted on the upper surface of bottom plate 64 and is magnetically connected to bottom plate 64. Top plate 63 is mounted on the upper surface of magnet 62 and is magnetically connected to magnet 62. Yoke 65 extends upward from the outer periphery of bottom plate 64. The inner peripheral surface of yoke 65 is located facing the outer peripheral surface of top plate 63. As a result, magnetic gap 56 is formed between the inner peripheral surface of yoke 65 and the outer peripheral surface of top plate 63. The outer peripheral surface of yoke 65 preferably has tapered part 65A so as to make loudspeaker 51 have a thin profile. Instead of being of the internal magnet type, magnetic circuit 61 may be of external magnet type or a combination of the internal and external magnet types.

Figure 9:
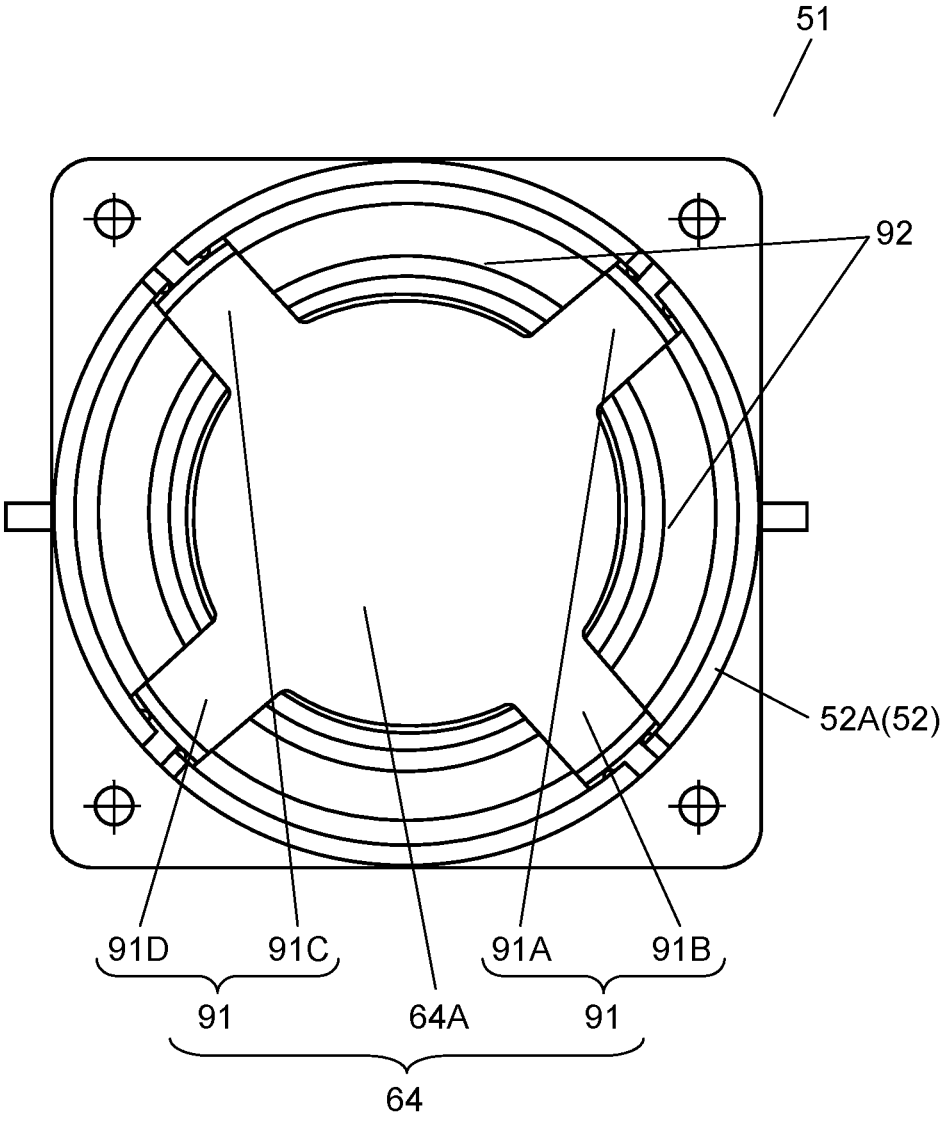
FIG. 9 is a rear view of the loudspeaker according to the present exemplary embodiment.

FIG. 9 is a rear view of loudspeaker 51. Bottom plate 64 includes installation part 64A, and preferably includes arms 91. Arms 91 extend from installation part 64A toward the outer periphery and are connected to frame 52. With this configuration, magnetic circuit 61 is connected to frame 52 via arms 91. In FIG. 9, arms 91 consist of four arms 91A, 91B, 91C, and 91D, but may consist of less or more arms than four.

Figure 10:
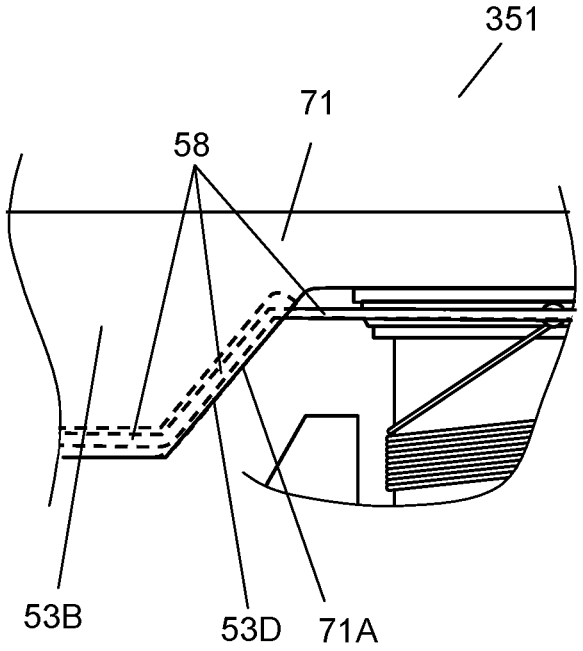
FIG. 10 is an enlarged side view of an essential part of another loudspeaker according to the present exemplary embodiment.
Figure 11:
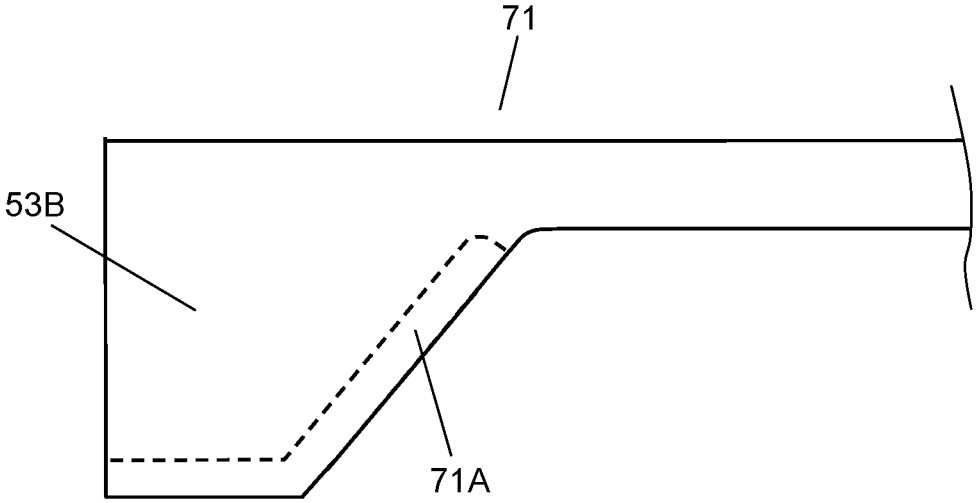
FIG. 11 is an enlarged side view of an essential part of a diaphragm of another loudspeaker according to the present exemplary embodiment.

FIG. 10 is an enlarged side view of an essential part of loudspeaker 351 according to the present exemplary embodiment. FIG. 11 is an enlarged side view of an essential part of diaphragm 71 of loudspeaker 351. Loudspeaker 351 includes diaphragm 71, which does not have through-holes 59 and, instead, has grooves 71A formed on the rear side (first side) of thick part 53B. At least part of relay wire 58 is routed along grooves 71A. Relay wire 58 passes through the rear side of thick part 53B and is led out from diaphragm 71 into gap 52D. Loudspeaker 351 is identical in other respects to loudspeaker 51. With this configuration, relay wire 58 occupies only a small region in the space between the rear side of diaphragm 71 and magnetic circuit 61.

Alternatively, instead of forming grooves 71A, relay wire 58 may be routed along inclined surface 53D. In other words, at least part of relay wire 58 may be routed along the rear side (first side) of thick part 53B. In this case, relay wire 58 is preferably bonded to inclined surface 53D so as to be prevented from vibrating while diaphragm 71 is vibrating, thereby occupying a smaller region. This configuration also prevents relay wire 58 from coming into contact with diaphragm 71, and hence, prevents diaphragm 71 from causing abnormal noise.

It is, however, preferable to form grooves 71A because they allow relay wire 58 to be routed along them, and hence, loudspeaker 351 to have a much thinner profile.

Grooves 71A preferably have a depth larger than the diameter of relay wire 58 so that relay wire 58 can be accommodated in grooves 71A and prevented from projecting from inclined surface 53D.

It is also preferable to fill grooves 71A with filler and to embed relay wire 58 in the filler, thereby preventing relay wire 58 from coming into contact with grooves 71A, and hence, preventing diaphragm 71 from causing abnormal noise.

Grooves 71A may be filled with adhesive instead of filler so as to ensure the prevention of relay wire 58 from coming into contact with grooves 71B, and hence, the prevention of loudspeaker 351 from causing abnormal noise.

Figure 12:
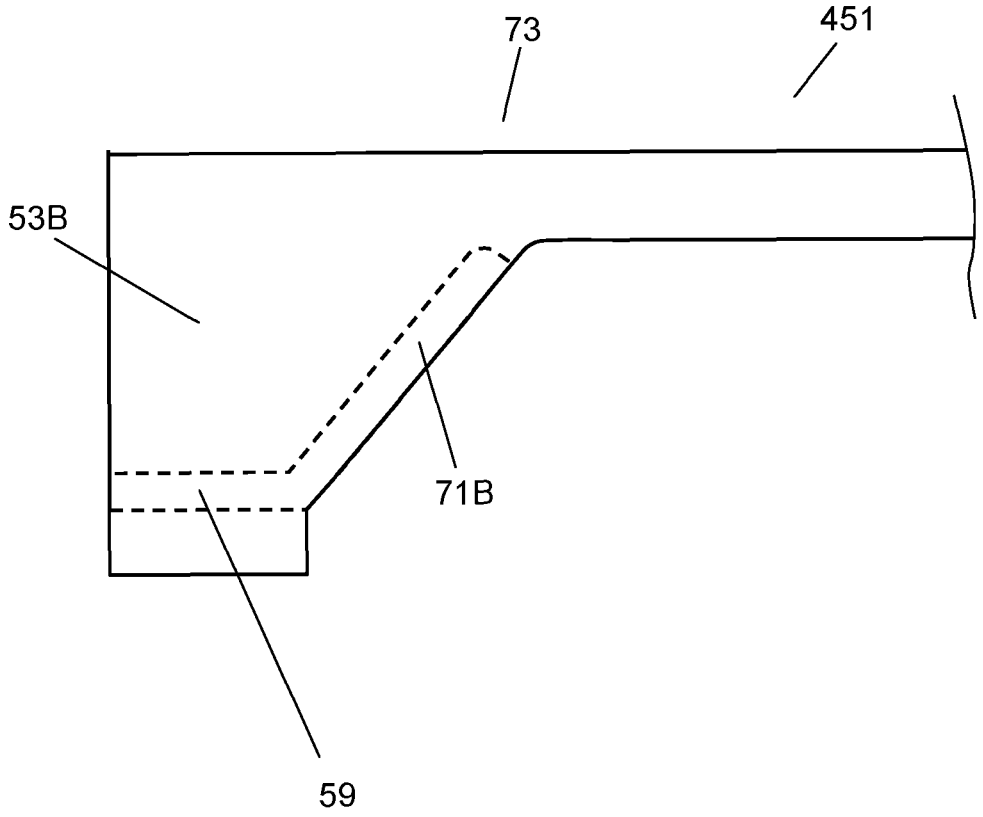
FIG. 12 is an enlarged side view of an essential part of a diaphragm of still another loudspeaker according to the present exemplary embodiment.

Alternatively, the diaphragm may have both grooves and through-holes. FIG. 12 is an enlarged side view of an essential part of diaphragm 73 of loudspeaker 451 according to the present exemplary embodiment. In thick part 53B, grooves 71B and through-holed 59 are formed instead of grooves 71A. Relay wire 58 may be inserted in part into through-holes 59 and be routed in part along grooves 71B. In this case, too, grooves 71B and through-holes 59 may be filled with filler or adhesive. Loudspeaker 451 is identical in other respects to loudspeakers 51 and 351.

With the above-described configuration, relay wire 58 occupies a smaller region in the space between the rear side of the diaphragm and magnetic circuit 61, thereby reducing the distance between the rear side of the diaphragm and magnetic circuit 61. As a result, loudspeakers 51, 351, and 451 can have a thin profile. Even if second edge 54B is formed on the rear side of thick part 53B, relay wire 58 can be prevented from coming into contact with second edge 54B, thereby making diaphragm 53 cause less distortion.

Figure 13:
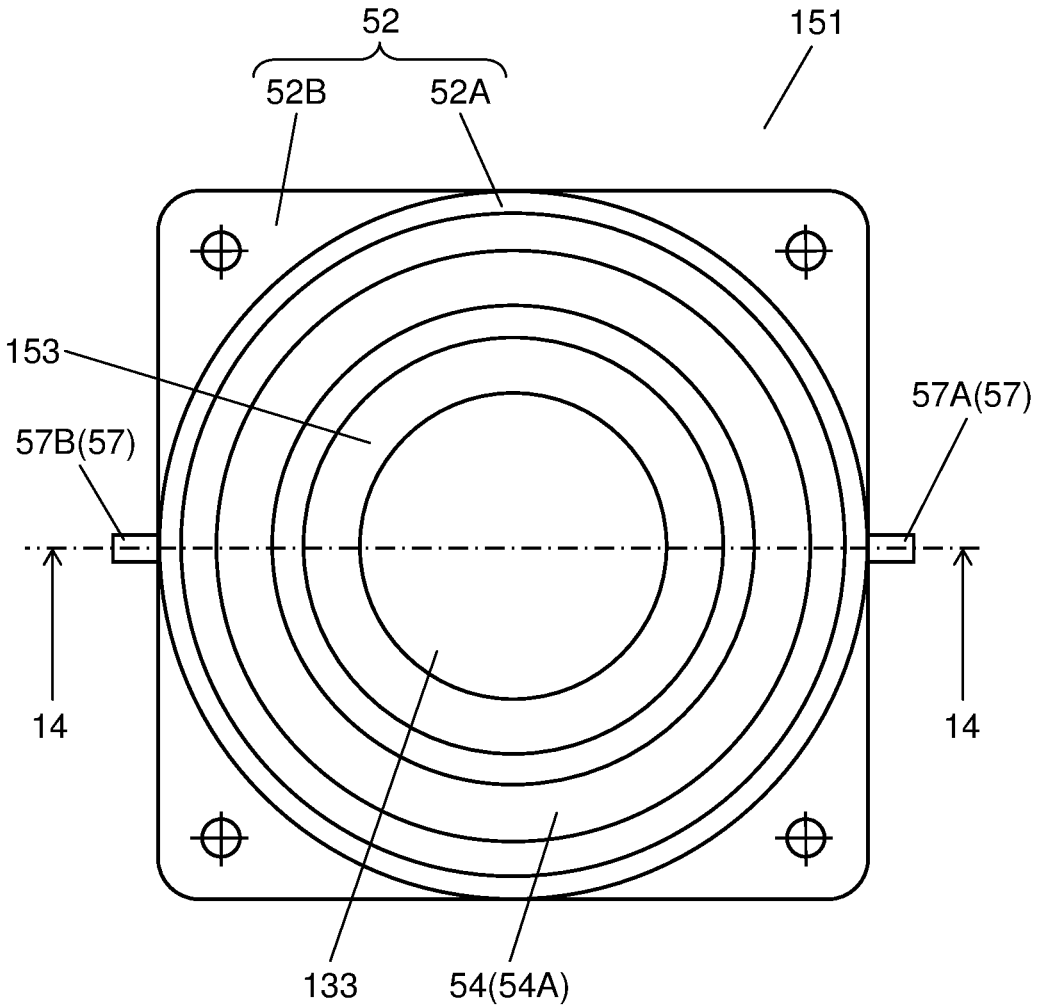
FIG. 13 is a front view of yet another loudspeaker according to the present exemplary embodiment.
Figure 14:
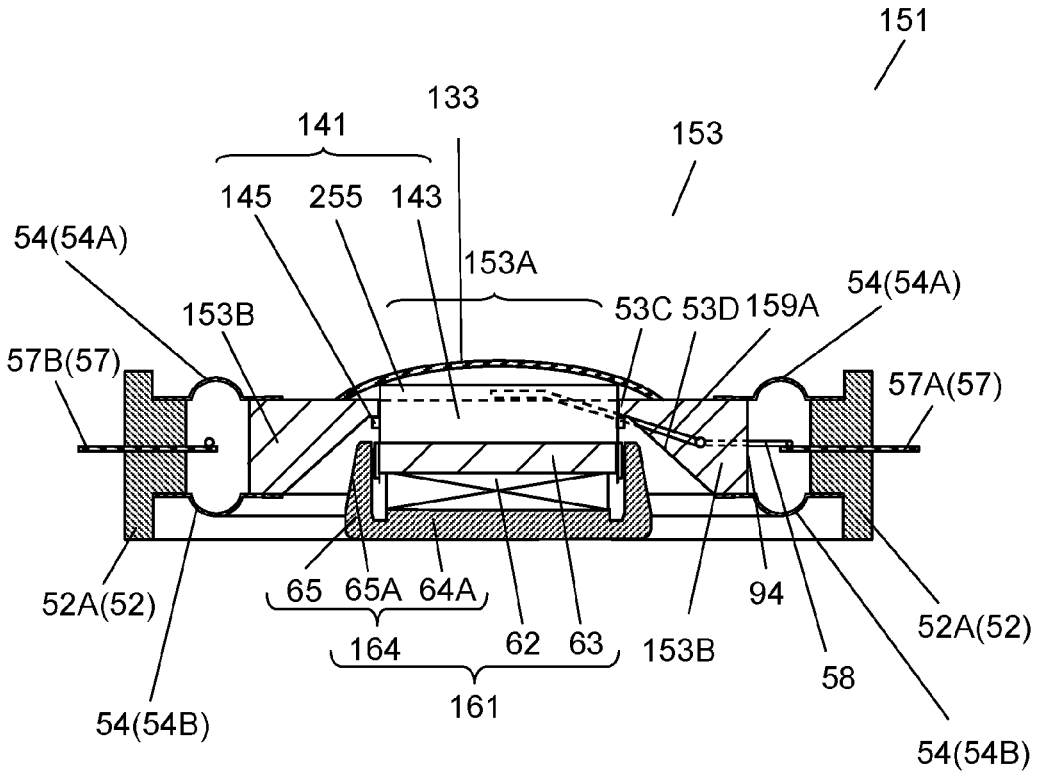
FIG. 14 is a sectional view taken along line 14-14 of FIG. 13.
Figure 15:
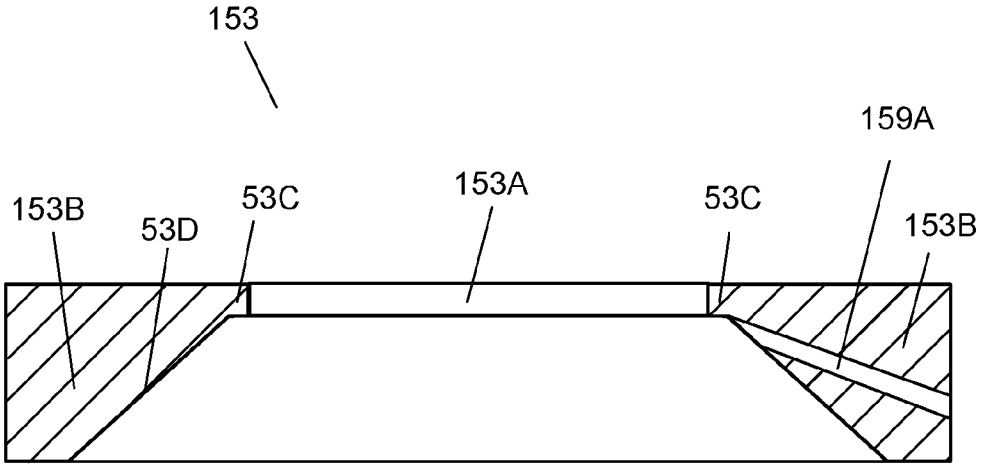
FIG. 15 is an enlarged sectional view of an essential part of a diaphragm of yet another loudspeaker according to the present exemplary embodiment.

FIG. 13 is a front view of loudspeaker 151 according to the present exemplary embodiment. FIG. 14 is a sectional view taken along line 14-14 of FIG. 13. In FIG. 14, the same components as in FIG. 3 are denoted by the same reference numerals, and the description thereof will be omitted. FIG. 15 is an enlarged sectional view of an essential part of diaphragm 153. Loudspeaker 151 includes diaphragm 153 and voice coil body 141 instead of diaphragm 53 and voice coil body 41 of loudspeaker 51. Voice coil body 141 includes bobbin 143 and voice coil 145. Magnetic circuit 161 includes bottom plate 164, magnet 62, and top plate 63. Bottom plate 164 includes yoke 65 and installation part 64A.

Diaphragm 153 has opening 153A in the center. As shown in FIG. 14, bobbin 143 has projection 255, which projects from the front side of diaphragm 153 through opening 153A. Loudspeaker 151 may further have center cap 133 in the center of diaphragm 153. Center cap 133 covers bobbin 143 and opening 153A. Center cap 133 is preferably connected to the front side of diaphragm 153 as well as bobbin 143, but may alternatively be connected to either one.

Diaphragm 153 has thick part 153B having through-holes 159A. Through-holes 159A penetrate between the front side (second side) of diaphragm 153 and outer peripheral surface 94 of diaphragm 153. In the front side of diaphragm 153, through-holes 159A are formed near opening 153A.

Figure 16:
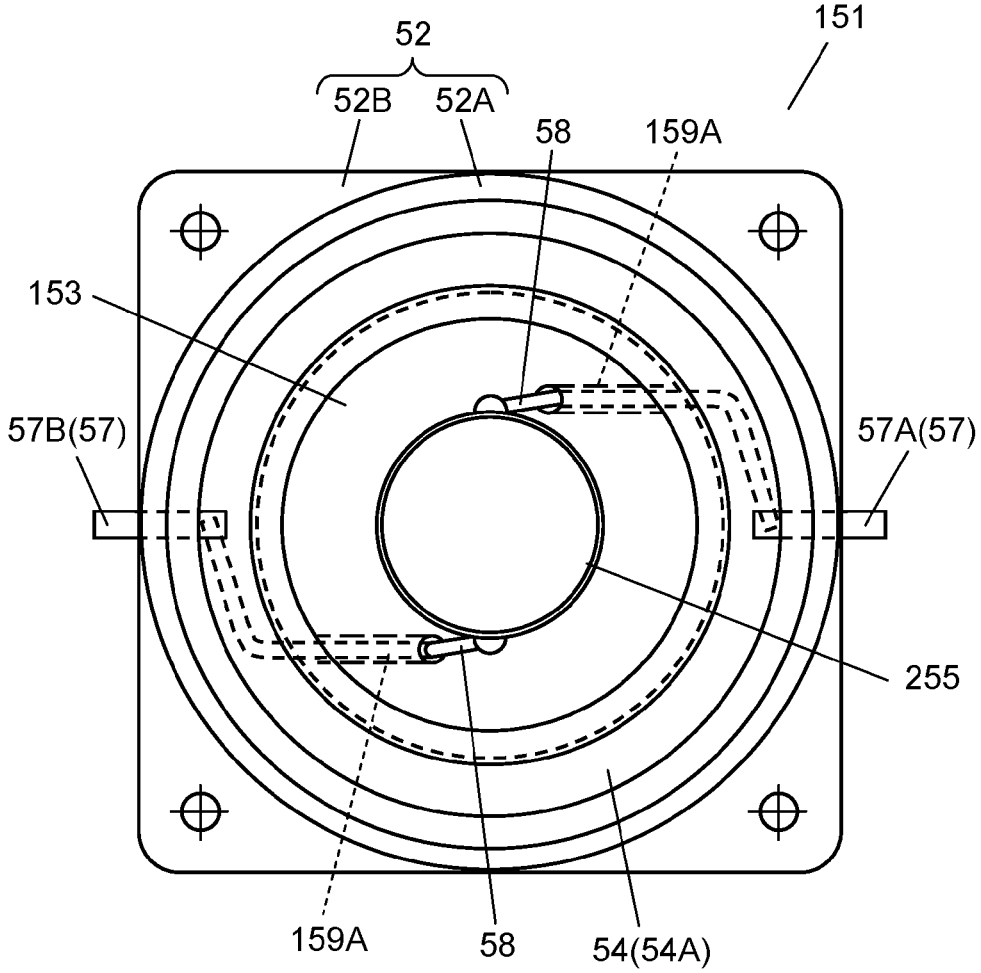
FIG. 16 is a top schematic view of yet another loudspeaker according to the present exemplary embodiment.

FIG. 16 is a top schematic view of loudspeaker 151 (center cap 133 is removed). Relay wire 58 penetrates through-holes 159A. More specifically, one end of relay wire 58 is led out from the front side of diaphragm 153, and the other end is led out from outer peripheral surface 94 of diaphragm 153.

Both terminals of voice coil 145 are led out to projection 255 along bobbin 143. In other words, both terminals of voice coil 145 are connected to relay wire 58 above bobbin 143, which penetrates diaphragm 153. The surface of bobbin 143 is preferably coated with an insulating film of, for example, varnish. Both terminals of voice coil 145 are fixed to relay wire 58 via the varnish or other adhesive, so that a drive signal can be sent to voice coil 145 via terminal 57.

The terminals of voice coil 145 and relay wire 58 may be connected together either on the front side or inside of diaphragm 153.

As shown in FIG. 14, in loudspeaker 151, relay wire 58 is absent between the rear side of diaphragm 153 and magnetic circuit 161. This allows diaphragm 153 and magnetic circuit 161 to be located close to each other, and hence, loudspeaker 151 to have a thin profile.

Figure 17:
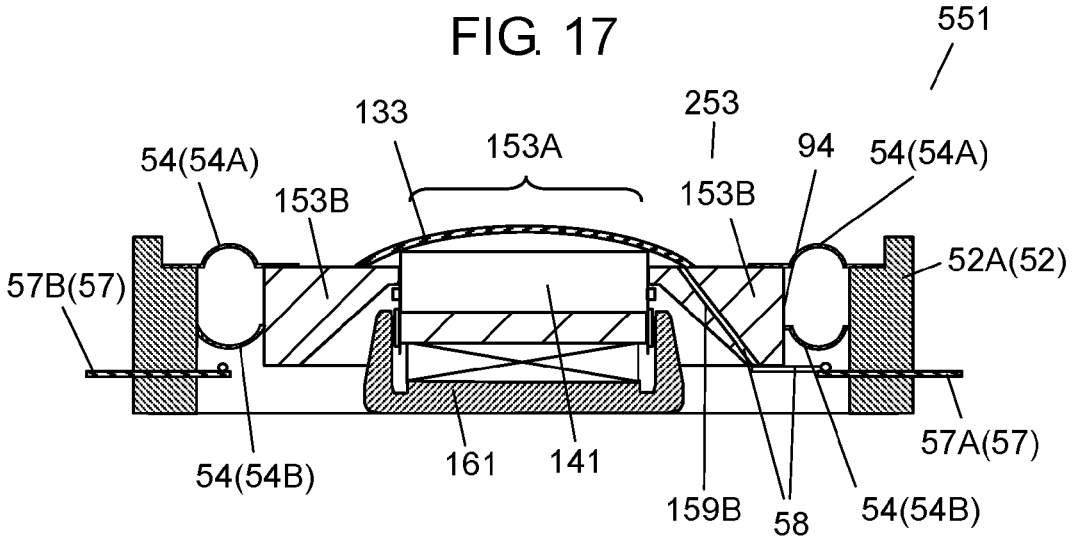
FIG. 17 is a sectional view of a further loudspeaker according to the present exemplary embodiment.
Figure 18:
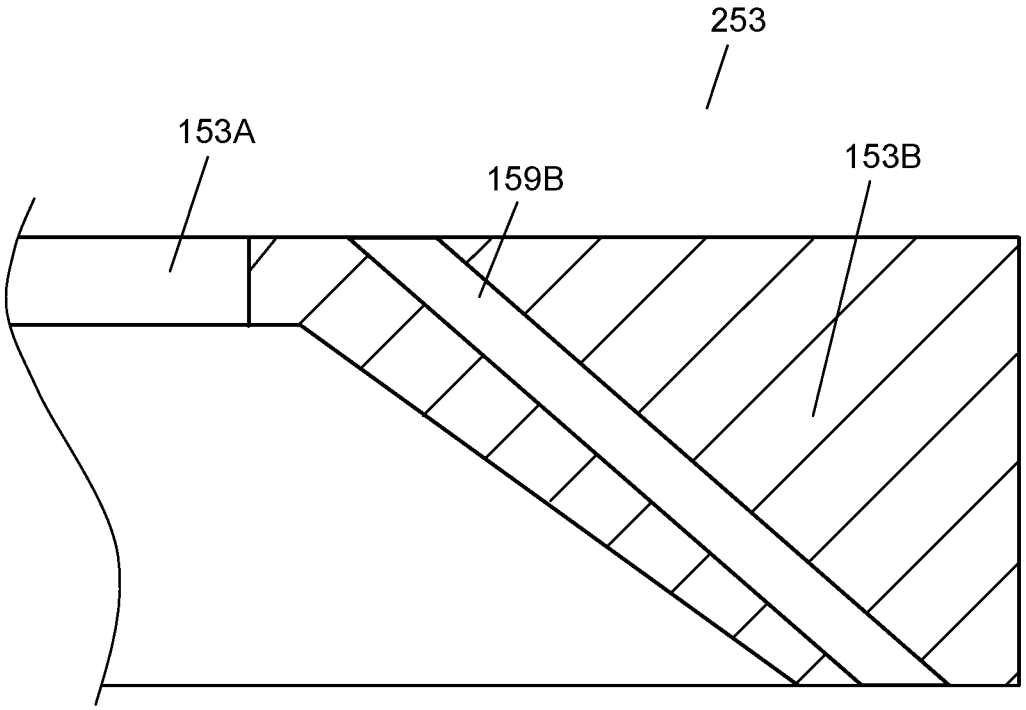
FIG. 18 is an enlarged sectional view of an essential part of a diaphragm of the further loudspeaker according to the present exemplary embodiment.

FIG. 17 is a sectional view of loudspeaker 551 according to the present exemplary embodiment. FIG. 18 is an enlarged sectional view of an essential part of diaphragm 253 of loudspeaker 551. In FIG. 17, the same components as in FIGS. 3 and 14 are denoted by the same reference numerals, and the description thereof will be omitted. Loudspeaker 551 includes diaphragm 253. Terminal 57 is located behind second edge 54B of frame 52. Diaphragm 253 has through-holes 159B instead of through-holes 159A. Through-holes 159B penetrate between the front side of diaphragm 253 and the rear side of thick part 153B. On the front side of diaphragm 253, through-holes 159B are formed near opening 153A.

Relay wire 58 penetrates through-holes 159B. More specifically, one end of relay wire 58 is led out from the front side of diaphragm 253, and the other end is led out from the rear side of thick part 153B and connected to terminal 57.

In the above configuration, relay wire 58 is absent between the rear side of diaphragm 253 and magnetic circuit 161. This allows diaphragm 253 and magnetic circuit 161 to be located close to each other, and hence, loudspeaker 551 to have a thin profile.

In outer peripheral surface 94 of diaphragm 253, second edge 54B is preferably located away from the outer peripheral end of the rear side toward the thickness direction of diaphragm 253. Loudspeaker 551 may alternatively include only first edge 54A, instead of second edge 54B.

Figure 19:
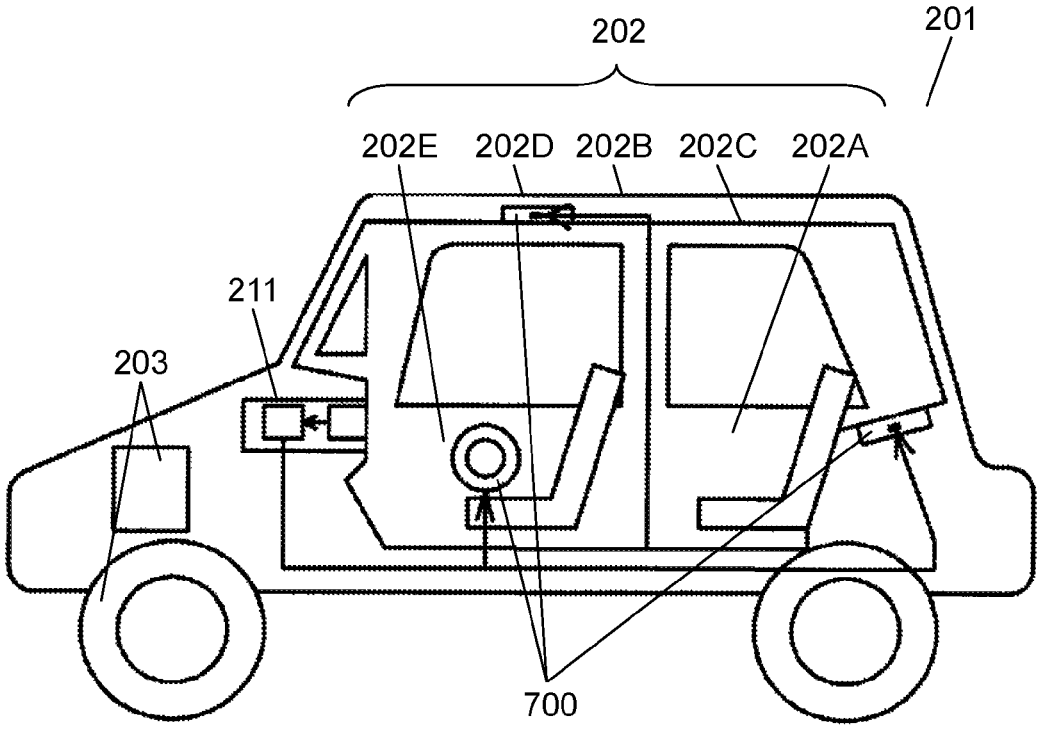
FIG. 19 is a conceptual view of a mobile device according to the present exemplary embodiment.

FIG. 19 is a conceptual view of mobile device 201 according to the present exemplary embodiment.

Mobile device 201 is equipped with loudspeaker 700. Loudspeaker 700 represents one of loudspeakers 51, 151, 351, 451, and 551 according to the present exemplary embodiment. In FIG. 19, mobile device 201 is an automobile, but may be other vehicles such as ships, airplanes, trains, and motorcycles.

Mobile device 201 includes body 202, drive part 203, amplifier 211, and loudspeaker 700. Drive part 203, amplifier 211, and loudspeaker 700 are mounted in body 202. Drive part 203 may include an engine, a motor, tires, a steering wheel, and other parts. The output of amplifier 211 is supplied to loudspeaker 700. Amplifier 211 may include part of a car audio system, and additionally include a sound reproducing device. Also, amplifier 211 may include part of a car navigation system, and additionally include a display device.

Body 202 includes passenger space 202A. Loudspeaker 700 is placed to deliver sound to passenger space 202A. Body 202 may further include exterior part 202B and interior part 202C. Exterior part 202B, which isolates passenger space 202A from the outside, can be, for example, roof 202D or door 202E. Interior part 202C is located between exterior part 202B and passenger space 202A. Loudspeaker 700 is placed between interior part 202C and exterior part 202B, but may alternatively be placed in a dashboard, a rear tray (not shown), or other places.

Loudspeaker 700 of the present exemplary embodiment has a thin profile and therefore can have a small distance between interior part 202C and exterior part 202B. In other words, loudspeaker 700 can be placed even if the distance is small between interior and exterior parts 202C and 202B. Thus, the use of loudspeaker 700 as mobile device 201 expands passenger space 202A.

The above-described exemplary embodiment is an example to facilitate the understanding of the present invention and does not limit the invention thereto. The materials and shapes of the components of loudspeaker 700 described in the exemplary embodiment can be variously modified.

For example, both terminals of the voice coil and the relay wire may be connected together at a place in the diaphragm, instead of the place shown in the loudspeaker of the exemplary embodiment.

The present invention, without departing from the spirit thereof, may be modified or improved and may include equivalents thereof.

As described above, in the loudspeaker of the present disclosure, the relay wire penetrates the thick part of the diaphragm and is connected to the terminals. The relay wire may alternatively be routed along the rear side of the diaphragm. This configuration can reduce the space, in which relay wire is conventionally routed, on the rear side of the diaphragm, thereby allowing the loudspeaker to have a thin profile.

INDUSTRIAL APPLICABILITY

The loudspeaker of the present disclosure has a thin profile and is therefore suitable for use especially in in-car audio systems and home audio systems.

The invention claimed is:

1. A loudspeaker comprising
a frame having a hollow;
a diaphragm located in the hollow of the frame and having:
a first side as a surface of a recess defined by a thin part and a thick part formed around the thin part; and
a second side opposite to the first side;
an edge connecting an outer peripheral end of the diaphragm and the frame;
a magnetic circuit placed facing the recess and having a magnetic gap;
a voice coil body including:
a cylindrical bobbin;
a voice coil wound around at least part of the bobbin,
the voice coil body being placed in a center of the diaphragm so that the voice coil can be located in the magnetic gap;
a terminal fixed to the frame; and
a relay wire having a first end connected to the terminal and having a second end connected to the voice coil, at least part of the relay wire being located in the thick part.

2. The loudspeaker of claim 1, wherein
the thick part has a through-hole; and
at least part of the relay wire is inserted in the through-hole.

3. The loudspeaker of claim 2, wherein the through-hole penetrates between an inner peripheral surface and an outer peripheral surface of the diaphragm.

4. The loudspeaker of claim 2, wherein the through-hole penetrates between the second side of the diaphragm and the outer peripheral surface of the diaphragm.

5. The loudspeaker of claim 2, wherein the through-hole penetrates between the first side and the second side of the diaphragm.

6. The loudspeaker of claim 2, further comprising a filler filled between the relay wire and the through-hole.

7. The loudspeaker of claim 1, wherein at least part of the relay wire is routed along the first side of the thick part.

8. The loudspeaker of claim 1, wherein
the first side of the thick part has a groove; and
at least part of the relay wire is routed along the groove.

9. The loudspeaker of claim 1, wherein
the edge includes:
a first edge; and
a second edge located on an opposite side of the first edge with respect to a center in a thickness direction of the thick part, and
the terminal is located between the first edge and the second edge.

10. The loudspeaker of claim 1, wherein
a gap is formed between a lateral side of an outer periphery of the diaphragm and an inner surface of the frame, and
the first end of the relay wire is connected to the terminal in the gap.

11. The loudspeaker of claim 1, wherein the terminal includes a positive terminal and a negative terminal, and
the positive terminal and the negative terminal are located 180° rotationally symmetric with respect to a central axis of the voice coil.

12. The loudspeaker of claim 11, wherein the relay wire includes:
a positive relay wire connecting a first terminal of the voice coil with the positive terminal; and
a negative relay wire connecting a second terminal of the voice coil and the negative terminal, and
the positive relay wire and the negative relay wire are located 180° rotationally symmetric with respect to the central axis of the voice coil.

13. The loudspeaker of claim 1, further comprising a connection part formed in the recess and connecting the relay wire and the voice coil.

14. The loudspeaker of claim 1, wherein
the thin part has an opening; and
the bobbin has a projection projecting from the opening.

15. The loudspeaker of claim 1, wherein the diaphragm is made of foamed resin.

16. A mobile device comprising:
a body;
a drive part mounted in the body;
an amplifier mounted in the body; and
the loudspeaker of claim 1 receiving an output of the amplifier.

17. The mobile device of claim 16, wherein
the body includes:
an interior part; and
an exterior part covering an outer periphery of the interior part with a predetermined space from the outer periphery, and
the loudspeaker is located in the space.

18. The mobile device of claim 17, wherein the exterior part is either a door or a roof.

* * * * *